United States Patent [19]

Bender et al.

[11] 3,964,232

[45] June 22, 1976

[54] METHOD OF PACKAGING FIBROUS MAT STRUCTURE

[75] Inventors: David John Bender, Toledo; Frank Steve Kubovich, Rossford, both of Ohio

[73] Assignee: Johns-Manville Corporation, Denver, Colo.

[22] Filed: May 19, 1975

[21] Appl. No.: 578,589

Related U.S. Application Data

[63] Continuation of Ser. No. 403,682, Oct. 4, 1973, abandoned, which is a continuation of Ser. No. 203,410, Nov. 30, 1971, abandoned.

[52] U.S. Cl. ..... 53/21 FW; 53/24; 53/118

[51] Int. Cl.[2] ..... B65B 63/04; B65B 63/02

[58] Field of Search ..... 53/21 FW, 23, 24, 118; 242/56.6, 56.8

[56] References Cited

UNITED STATES PATENTS

| | | | |
|---|---|---|---|
| 2,681,702 | 6/1954 | Kuenn et al. | 53/118 X |
| 2,789,406 | 4/1957 | Mosier | 53/118 |
| 3,416,287 | 12/1968 | Hawkins et al. | 53/21 FW X |
| 3,537,226 | 11/1970 | Le Van et al. | 53/21 FW X |

*Primary Examiner*—Travis S. McGehee
*Attorney, Agent, or Firm*—Robert M. Krone; Joseph J. Kelly; James W. McClain

[57] ABSTRACT

Fibrous mat, e.g. glass fiber, having a sheet facing on one face is wound in continuous lengths with minimum tension, compression, shear and working during the winding and with a large open center. The coils are compressed by a straight line compression generally normal to the major face of the mat and packaged with greater compression than heretofore acceptable in view of the recovery of insulation thickness upon installation. Nearly complete recovery is experienced. Further, stresses on the coiled material during compression and packaging are insufficient to destroy the longitudinal integrity even when it is skip chopped in a manner which separates more readily than prior skip chopped strip.

Skip chopped strip is perforated transversely for manual separation at the point of installation by cutting through the tab margins of the facing to the edges thereof and cutting through the mat and facing in a line leaving narrow columns of glass fiber backed by the facing to maintain the longitudinal integrity of the mat. A blade having cutting edges which sever the extremes of the facing margin for a plurality of simultaneously cut strips is employed.

1 Claim, 9 Drawing Figures

INVENTOR.
DAVID JOHN BENDER
FRANK STEVE KUBOVICH
BY J. A. McKinney

INVENTOR.
DAVID JOHN BENDER
BY FRANK STEVE KUBOVICH
J. A. McKinney

METHOD OF PACKAGING FIBROUS MAT STRUCTURE

This is a continuation of application Ser. No. 403,682, filed Oct. 4, 1973 which is a continuation of application Ser. No. 203,410 filed Nov. 30, 1971, and now abandoned.

BACKGROUND OF THE INVENTION

Heretofore fibrous mat having a facing serving as a gas barrier, vapor barrier, reflective coating or the like has been cut into convenient lengths, stacked and packed under compression as batts or has been rolled under tension and compression and further compressed for packaging. A compromise combination of the advantages of the continuous length roll of insulating wool and the individual batt form of wool has been sought by attempts to perforate a continuous length of insulating mat transversely at regular intervals so that it can be separated manually in the field at the point of installation. This has been termed skip chop material.

Each of the forms of insulating strips of wool or mat have exhibited attributes and liabilities. The insulating properties of fibrous mat are a function of the thickness of the mat as installed. Shipping costs dictate minimizing the volume of the packaged product. An objective long sought in the art is to minimize the shipping volume of mat while maximizing its installed thickness and thus its recovery when released from compression in its package. The batt package exhibits the best recovery following a given degree of compression. This permits the greatest compaction and thus freight and warehousing savings is substantial. However, it presents problems in packaging since it is manually collected and stacked for compression. Labor cost for packaging is substantial. A wrong count of batts is sometimes placed in a package. When opened, a package of batts exhibit a resilience which tends to cause the batts to fly apart. The batts must be picked up individually for installation with resultant increased installation labor and cost.

The continuous length rolls exhibit poorer recovery and thus cannot be compacted to the degree to which batts for the same application are compacted. They therefore are more expensive to store and ship. Installation requires the roll to be cut into appropriate lengths in the field. Frequently, the rolls recover to vastly different degrees depending upon their position in the package since the leading roll when inserted into the package is subjected to less stress than the trailing roll against which the packer ram bears.

The prior skip chopped insulation was packaged in rolls which were unsatisfactory from the standpoint of thickness recovery, tended to have damaged facings due to the stresses imposed in rolling and packing and could be separated only with difficulty and frequently with an uncontrolled tearing of the facing at other than the perforated regions. Attempts to weaken the perforations for enhanced separating characteristics resulted in greater frequency of accidental breaks in the facing and batt lengths during rolling, packaging and installing.

SUMMARY OF THE INVVENTION

The present invention relates to an improved skip chopped strip insulation, method of packaging strip insulation, and apparatus for packing of fibrous insulating material in roll form.

More particularly, fibrous insulating material is formed in a thick mat of randomly disposed fibers bound together at their interstices. It has a facing sheet applied to at least one face usually with the longitudinal edges of the facing reinforced. It is perforated transversely at predetermined intervals, to define convenient potential batt lengths, in a manner to insure the severance at the outer marginal edges and to leave columns of fiber and facing as longitudinal coupling means which can be torn manually. The continuous lengths of material skip chopped in the above manner are gathered under minimum compression and tension to minimize stressing and working of the material and the bonds from fiber to fiber and from fiber to the facing.

One form in which the material is gathered is in a roll in which a large open center is initially established and in which the outer periphery is driven over a substantial portion of its exposed length at essentially the speed the material issues from the mat forming apparatus. The rolls are wound loosely, that is the peripherial drive means is opened at a rate generally corresponding to the increase in roll diameter as the uncompressed mat is wound thereon. Advantageously, little compression of the material occurs in winding and essentially no hoop stress is developed tending to break the fibers or their bonds. No flexing is imposed due to compression or tension as the material is fed into the roll and the roll is rotated around its winding axis.

In practice the completed rolls are so loose they tend to form an elliptical spiral when viewed along their winding axis. This spiral has a major axis in the horizontal when permitted to rest free of the winding equipment with its winding axis horizontal. A plurality of these elliptical rolls are stacked and compressed to a form wherein they approach a compressed stack of individual batts. When thus compressed, the rolls are bagged or otherwise packaged.

In essence, the insulation wool and backing is subjected to a single straight line stress. It is believed that the reduced amount of flexing and stressing produces the superior end product obtained. In practice a 5 ¼ inch thick mat of glass fiber insulation when subjected to a 6 to 1 compression ratio in the prior art roll packaging technique recovers approximately 4 inches in thickness on installation. An elliptically packed material of 5 ¼ inch original thickness can be compressed 8 to 1 and will recover to 4 ½ to 5 inches.

A feature of this invention resides in an improved packaging method producing an end product offering to more complete recovery by restricting stresses imposed in manufacture and packaging to compression normal to the major face of the mat.

Another feature resides in an improved, stable, rolled, skip chopped product having facing with severed longitudinal margins.

A third feature is the method of winding of continuous lengths of faced fibrous insulation which results in imposition of minimum compression and tension on the mat.

A fourth feature is a chopper blade arranged to partially sever a plurality of strips of faced insulation with all longitudinal margins of the facings for the strips severed and a cooperating anvil which enables the strips to be completely severed with the blade at selected points.

DETAILED DESCRIPTION OF THE PREFERRED EMBODIMENT

Figure 1:
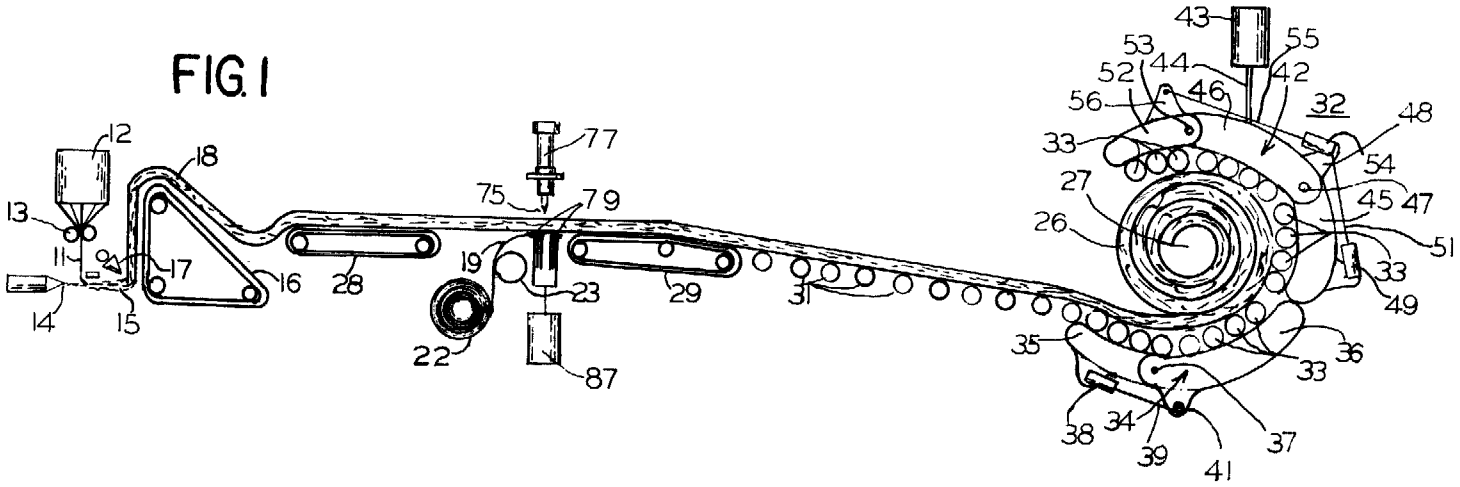
FIG. 1 is an over-all schematic side view of one form of apparatus for producing skip chopped, faced, continuous lengths of fibrous insulation mat in roll form according to this invention.

While the preferred material for fibrous insulation according to this invention is glass which can readily be formed in fine diameters at appropriate lengths, it is to be understood that other materials can be fiberized as by usual means of spinning, drawing, attenuating and blowing into fine diameter filaments for all or part of the insulating mat. These may include known products manufactured from various source materials of silicates of metal oxides, such as rock wools, from argillaceous matter or shale, slag wool from metallurgical slags, each commonly referred to as "mineral wools", aluminum silicate fibers and any fibers of the so-called glasses.

Glass fibers are made by passing continuous glass filaments 11 through small orifices in pots 12 containing molten glass. The filaments 11 are passed over pull rolls 13 and softened by hot gaseous blasts 14 or can be subjected to blasts of steam while still molten (not shown) to attenuate the filaments 11 into small lengths of individual fine fibers 15. the fibers 15 are collected on a moving formation conveyor 16 and a binder 17, typically a thermosetting resin, is introduced into the mat 18.

Ordinarily mat 18 is formed in much greater widths than its ultimate commercial form, as on a bed 144 inches wide and is slit (by means not shown) into various widths. Strips of facing sheet 19 which can be paper having back folded longitudinal edges 21 of double thickness to provide mounting tabs is secured to the mat either prior to or subsequent to slitting with the facing maintained in registry with the mat strips. The facing is drawn from a coil 22 and, in the case of precoated paper carrying an asphaltic adhesive on the face contacting the glass wool, it is drawn over a heated roll 23 to activate the adhesive and then carried in beneath the wool mat 18.

Figure 9:
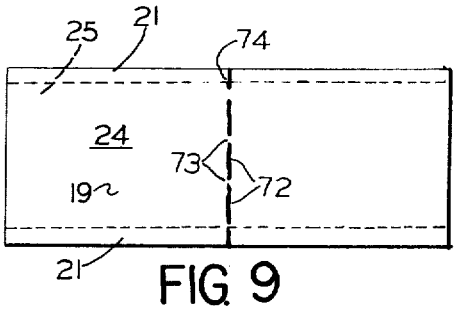
FIG. 9 is a plan view of a section of the faced side of skip chopped insulation according to this invention.

The resultant product is, as shown in FIG. 9, a strip 24 of glass wool mat 25 about 5 ¼ to 5 ⅜ inches thick adhered to a facing 19 of paper or foil having reinforced longitudinal edges 21 extending laterally beyond the mat and of extra strength whereby the mat can be secured, as to joists in home construction.

Conventional, faced insulation, according to this invention, is packaged in continuous lengths by winding it into rolls 26 having open centers 27 in a manner to avoid or substantially eliminate undesirable stressing, working, fiber breakdown, fiber to fiber bond breakdown, and mat to facing bond breakdown. In the prior art compaction has been sought in the faced mat at the time it is rolled by tightly winding the roll under tension and compression. In processing mat, it is advanced over a series of conveyors some of which may be continuous as chain belts 28 and 29 and some of which can be individual rollers 31 in sections driven at constant speed. Ordinarily, each succeeding conveyor section is driven at a speed about 10% faster than its next proceding section. In prior windup mechanisms using an expandable array of driven rollers either in conjunction with a mandrel or with no mandrel, the winding speed is greater than the next succeeding conveyor and winding pressure is imposed by the compression of the mandrel on the lead-in rollers by compression of the upper section of windup rollers on the lower windup section. The tension and the angle at which windup compression is imposed while developing a 6:1 compression ratio imposes shearing stresses between fibers and from fiber to facing which tends to breakdown the mat structure and thus impair recovery when the material is unrolled.

It has been found that essentially full recovery can be obtained if the working of the material is avoided in windup and particularly if the shear stresses are avoided. In accordance with this concept, as applied to an external windup 32 having no central mandrel, the driving rolls 33 in the windup are driven at about the same speed or less than the rolls 31 of the final conveyor from which mat is delivered to the windup. Thus the rolls 31 can overrun and have some slip with respect to the mat facing 19. Further, the windup 32, which is composed of a number of articulated sections is programmed to maintain only a sufficient pressure to maintain traction for coiling the roll 26. Thus, a compression of less than 2:1 is imposed in winding the roll 26.

More particularly, the windup 32 is composed of a lower articulated unit 34 including a lead-in section 35 and a trailing section 36 pivoted at 37 on the lead-in section and moved about the pivot according to the windup program by the cylinder 38 and piston rod 39 to bell crank 41 on section 36. A frame work (not shown) supports the windup 32 and is arranged to mount an upper articulated unit 42 which can be adjusted in elevation as the roll builds as by means of a hydraulic elevator represented by cylinder 43 and piston rod 44. Upper unit 42 is shown articulated twice. The base section 45 is guided for vertical motion relative to the support frame by suitable means (not shown) and can be arranged for rotation about a pivot (not shown) normal to the plane of FIG. 1. A second section 46 is pivoted at 47 on base 45 and has an integral bell crank 48 upon which cylinder 49 secured to base 45 and piston rod 51 operate. In similar fashion a third section 52 is pivoted at 53 on section 46 by a cylinder 54 secured to 46 having a piston rod 55 operate on bell crank 56.

In practice, the windup of a roll is initiated with section 36 closed, the upper unit 42 lowered and sections 46 and 52 closed to define a relatively small and almost completely enclosed region into which the end of the strip of mat 18 is advanced, turned upward by the driven rollers 33 on section 36, turned back upon itself by the driven rollers 33 on sections 45 and 46 and turned downward into the next turn of mat by rollers on section 52. The several sections are so positioned initially that when the first turn of the roll is closed, an open region about 10 inches in diameter remains. Generally, the rolls are of a standard length which have ranged from 24 to 96 feet for standard commercial product. The final rolls in the preferred form are 36 inches in diameter with a tolerance of plus or minus an inch.

In the case of windups which employ mandrels either with or without constraining rollers, the open center is maintained in roll 26 by employing a large mandrel. Compression is avoided by counterbalancing the mandrel to substantially eliminate its downward pressure on the underlying rollers of the conveyor mechanism and windup. Further, if overlying rollers are employed, they are programmed to open as the thickness of uncompressed material builds up to avoid compression on the upper side of the mandrel. Tension on the insulation mat is avoided in the same manner as with the illustrated driven rollers 33 by adjusting the speed of rotation of the mandrel or the peripherial drive rollers to be somewhat less than the speed of the conveyor advancing the mat to the windup.

These loosely wound rolls are packaged, four to a bag, in apparatus as shown in FIGS. 4 through 8. In the packaging process, the forces imposed upon the mat are essentially compressive forces normal to the major plane thereof and not angularly related to that plane as the shear inducing forces of prior compressive windups.

Figure 4:
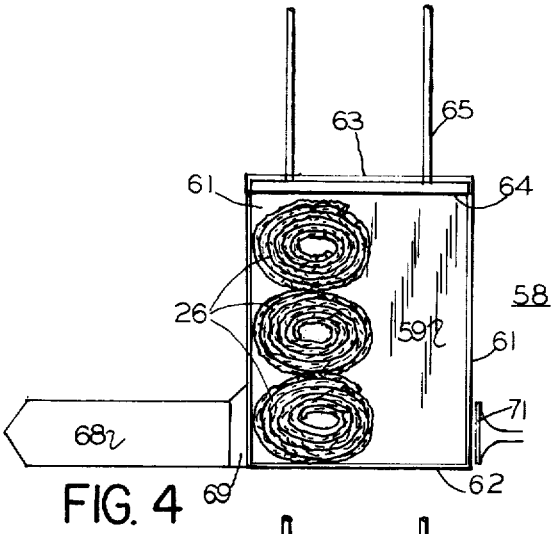
FIG. 4 is a front view of a bag packer and compacting chamber for rolls made up according to this invention showing the initial mounting of three superposed rolls for compaction.
Figure 5:
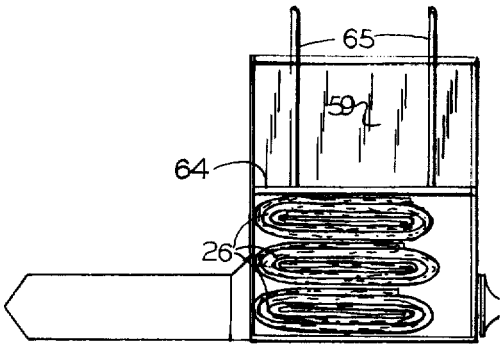
FIG. 5 is a view of the compacting chamber as in FIG. 4 with the initially mounted rolls compacted to make room for an additional roll.
Figure 6:
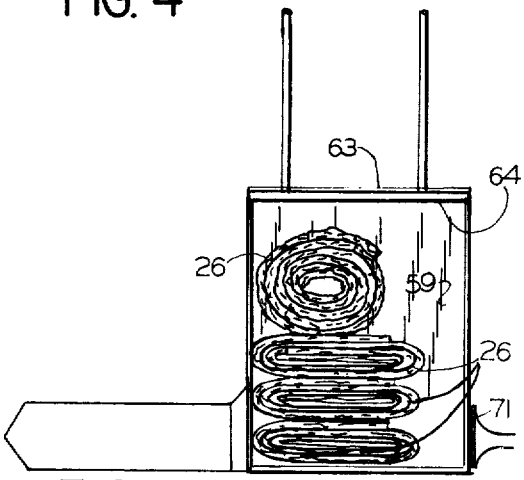
FIG. 6 is a view as FIG. 5 with the rolls partially compacted.

As shown in FIG. 4, coils or rolls 26 of mat are stacked one upon the other in a compartment 58 having a back wall 59, end walls 61, a bottom 62 forming a fixed platen and a top 63. A vertically guided horizontal ram 64 can be moved from the upper portion of compartment 58 downward toward platen 62 by push rods 65 which can be piston rods from pistons (not shown). In moving ram 64 downward, the rolls 26, which by virtue of their open centers and flexibility, tend to assume an elliptical form, are compressed from their original 36 inch outside diameter, and 10 inch open center to a flattened and elongated form approaching a group of batts folded upon themselves. Thus, with a packer compartment 84 inches high, three rolls are fitted into the packer as shown in FIG. 4 and the horizontal ram 64 or other compressing means (not shown) compress the rolls to the elongate form of FIG. 5. Thereafter, the ram 64 is retracted and a fourth roll 26 placed above the partially compacted rolls as shown in FIG. 6. These superposed rolls are then compacted by ram 64 so that the four rolls of an original 36 inch diameter each are compressed to a total thickness of 15 inches and expand in the horizontal dimension to 48 inches as shown in FIG. 7.

Figure 7:
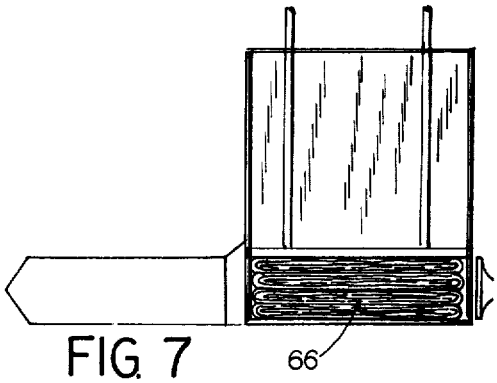
FIG. 7 is a view as FIG. 5 with the rolls compacted for insertion into a bag by the packer ram.
Figure 8:
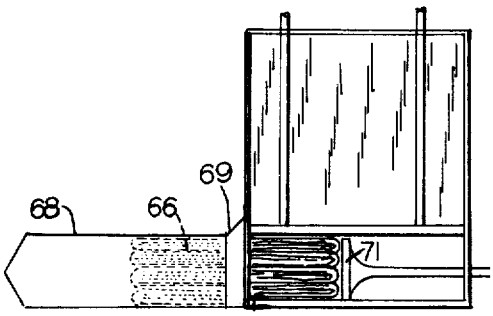
FIG. 8 is a view as FIG. 5 with the compacted rolls partially inserted in a bag.

The batt-like stacked coil array 66 of FIG. 7 is packaged in a bag 68 secured to a suitable tapered chute 69 at one side to packer compartment 58 by means of a vertically disposed ram 71. Ram 71 is advanced across compartment 58 while ram 64 is in its downwardly extended position to advance compressed coil array 66 into chute 69 from which it is guided into bag 68 as shown in FIG. 8.

Insulation packed in the above manner to an 8:1 compression ratio enables 15 inch wide mat in four 40 foot rolls to be packaged in a bag 15 inches by 15 inches by 48 inches and to recover to 4 ½ to 5 inches thick. The absence of shear stress and tension in the insulation strip offers the further advantage that the mat strip can be partially severed by transverse perforations which provide minimum holding power between successive sections without breaking the strip into individual batts during manufacture, packaging, and unpackaging in the field. Prior attempts to produce skip chopped insulation required only limited severing of the strip and resulted in poor separation with streamers of both facing and wool running from the perforated area. According to this invention the strip is formed into separable batts by a complete severance of the wool and facing in a series of cuts 72 in a straight line across the strip with ½ inch wide columns 73 of wool and facing to couple successive sections, as shown in FIG. 9. The outer longitudinal margins of the facing tabs 21 are severed as at 74, preferably completely across the tabs to facilitate the initiation of separation. For example, in an eleven inch wide strip, three columns of ½ inch width of wool and facing have been found satisfactory, while a 19 inch wide strip with from four to six such columns sustains its unitary form until it is desired to pull the material apart.

Comparatively, it has been found that prior skip chopped product rolled conventionally when subjected to a tear-apart test with force normal to the perforations required a range of loads of 230 to 355 pounds to separate the material while the same material packaged and perforated according to this invention separated with a range of loads of 28.5 to 46 pounds. Trapezoidal tear-apart test where the force is concentrated on one side and progresses across the strip required an average initial force of 9.1 pounds to initiate a tab tear. It then required. a continuing application of an average force of 10 pounds to propogate the tear across the strip. The average load to propogate the tear on the material chopped according to this invention was 2.2 pounds. While the more nearly complete severance of the facing and wool reduces the tearing force required, the substantial elimination of stress in the winding and packaging method set forth enables the strip integrity to be maintained.

Figure 2:
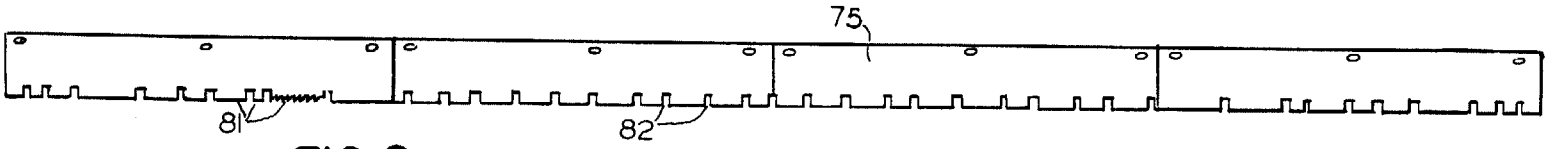
FIG. 2 is a diagrammatic plan of the blade for skip chopping and severing a plurality of strips of faced, fibrous insulating mat according to this invention.
Figure 3:
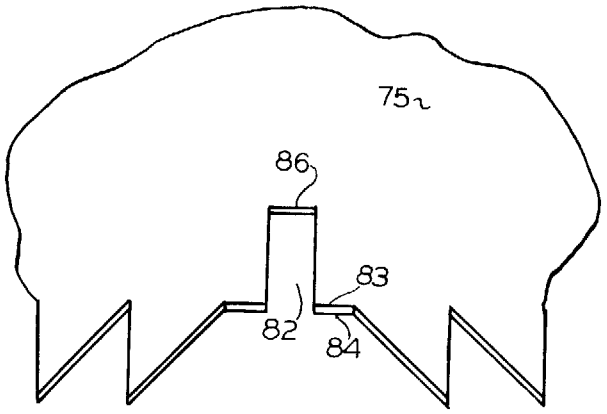
FIG. 3 is an enlarged detail of the blade of FIG. 2 taken around the transverse centerline thereof.

The skip chopping and complete severance of strips is accomplished by a single blade 75 and anvil 76 combination as shown in FIGS. 1, 2 and 3. Blade 75 is located above the strip 18 at a station down stream from the point of application of facing 19. It is arranged to be moved normal to the strip as by a two-way pneumatic cylinder 77 which extends and retracts the blade 75 rapidly in accordance with the control of a suitable feed length measuring means (not shown). The travel of the blade 75 is fixed. It operates against an anvil 76 which is below the strip 18 and facing 19 and has a blade receiving slot 78 between two flat bearing surfaces 79.

A blade 75 for a system producing wool mat 144 inches wide is shown in FIG. 2. It is arranged with groups of teeth 81 forming the slits 72 in the wool and facing separated by notches 82 providing the connecting columns 73 of wool and facing. Only a representative group of teeth is shown in FIG. 2. The teeth are beveled to point in opposite directions around the centerline of the blade as shown in the detail, FIG. 3. All edges of the blade having a component normal to the chopping motion imparted to the blade are sharpened. Thus, where the space at the end of a group is too narrow to accommodate a tooth, as at 83 of FIG. 3, the blade is flattened at the tooth base line 84 and is sharpened as at 85. The base of notch 82 is sharpened at 86 to provide a cutting edge for severing the entire strip. This is accomplished with a standard stroke of blade 75 by displacing anvil 76 upward sufficiently so that the edge 86 at the notch base passes below the bearing surfaces 79. Pneumatic cylinder 87 drives the anvil upward and retracts it in conjunction with the control of blade 75 as determined by the feed length responsive control.

Typically, full rolls are made up of skip chopped batts. Thus, if the product is to be 96 inch long batts, typically a roll could comprise five skip chopped batts. Such a strip will have only blade 75 displaced for four successive operations each controlled by the advance of 96 inches of mat and on the fifth such advance will displace both the blade and anvil to completely sever the mat and facing.

It is to be understood that the method, apparatus and product set forth in this disclosure lend themselves to many variations. Accordingly, the disclosure is to be read as illustrative of the invention and not in a limiting sense.

We claim:

1. In a method for packaging a continuous length of bonded glass fiber insulating mat product having a facing of sheet material bonded to one major surface of the mat wherein the mat is advanced toward a winding operation having a winding axis normal to the direction of advance, the mat is perforated normal to a major face of the mat and in a line transverse of its direction of advance whereby subsequent separation of the mat into discrete lengths at the point of use is facilitated, and the mat is turned solely upon itself in the winding operation to form a multi-layered roll, the improvement comprising:

a. guiding and turning the mat solely upon itself to form a roll with an open center core which is defined by the mat and permits the roll to assume an elliptical shape after it has been formed, b. driving the mat being wound on the roll and forming a peripheral layer of the roll at a speed substantially the same as the speed at which mat is fed into the winding operation to loosely wind the mat on the roll, c. confining the roll being formed to a volume which increases in diameter at a rate substantially equal to the rate that the diameter of the roll being formed increases to loosely wind the mat on the roll, producing a compression of the mat of less than 2:1, d. compressing the open-centered roll of mat formed in steps (a), (b), and (c) in a direction normal to its wound axis, to compress the mat under a compression ratio of at least 6:1 without separating the mat into discrete lengths, and e. applying constraining means to the compressed roll.

* * * * *